US006918845B2

(12) United States Patent
Kudla

(10) Patent No.: US 6,918,845 B2
(45) Date of Patent: Jul. 19, 2005

(54) GOALTENDER TRAINING APPARATUS

(76) Inventor: Michael J. Kudla, 3 Summit Ave., Groton, MA (US) 01450

( * ) Notice: Subject to any disclaimer, the term of this patent is extended or adjusted under 35 U.S.C. 154(b) by 245 days.

(21) Appl. No.: 10/435,254

(22) Filed: May 8, 2003

(65) Prior Publication Data

US 2004/0224796 A1 Nov. 11, 2004

(51) Int. Cl.[7] ..... A63B 63/00
(52) U.S. Cl. ..... 473/478; 273/127 R
(58) Field of Search ..... 473/446, 478, 473/480; 273/127 A, 127 R

(56) References Cited

U.S. PATENT DOCUMENTS

| | | | | |
|---|---|---|---|---|
| 4,749,189 | A | 6/1988 | Frank | 272/136 |
| 4,948,147 | A | 8/1990 | Pallanca | 273/402 |
| 4,995,607 | A | 2/1991 | Whitefield | 273/26 R |
| 5,271,624 | A | 12/1993 | Sciortino | 273/411 |
| 5,465,958 | A | 11/1995 | Brun | 273/57.2 |
| 5,509,650 | A | 4/1996 | MacDonald | 273/26 R |
| 5,584,481 | A | 12/1996 | Caluori et al. | 273/57.2 |
| 5,643,094 | A | 7/1997 | Macri et al. | 472/92 |
| 5,647,747 | A | 7/1997 | Macri et al. | 434/247 |
| 5,709,620 | A | 1/1998 | Reinprecht | 473/459 |
| 5,725,444 | A | 3/1998 | Heden | 473/446 |
| 5,800,312 | A | 9/1998 | Ormondroyd | 482/51 |
| 5,890,906 | A | 4/1999 | Macri et al. | 434/247 |
| 5,895,330 | A | 4/1999 | Reilly, Jr. | 473/446 |
| 6,059,673 | A | 5/2000 | Mason | 473/478 |
| 6,073,489 | A | 6/2000 | French et al. | 73/379.01 |
| 6,098,458 | A | 8/2000 | French et al. | 73/379.04 |
| 6,164,973 | A | 12/2000 | Macri et al. | 434/247 |
| 6,308,565 | B1 | 10/2001 | French et al. | 73/379.04 |
| 6,331,168 | B1 | 12/2001 | Socci et al. | 600/595 |
| 6,430,997 | B1 | 8/2002 | French et al. | 73/379.04 |
| 2002/0121742 | A1 | 9/2002 | Stauber | 273/458 |

*Primary Examiner*—Kim Nguyen
(74) *Attorney, Agent, or Firm*—Weingarten, Schurgin, Gagnebin & Lebovici LLP

(57) ABSTRACT

A training device for a goaltender employs a plurality of transceivers mounted within a housing that emit beams that are reflected off of cooperative reflectors attached to a goal. The transceivers and reflectors are aligned such that uninterrupted reflected beams are sensed by the emitting transceiver. A visual indication is provided to a goaltender positioned between the goal and the training device whether the goaltender is positioned so as to block shots from a point between the training device and the goal to a plurality of specified areas of the goal so as to provide feedback to the goaltender with respect to goal coverage.

13 Claims, 4 Drawing Sheets

GOALTENDER TRAINING APPARATUS

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to training apparatus for use in a sport in which the object of the sport is to propel an object past a goaltender into a goal, and more specifically, a training device that permits a goaltender to determine when he is properly positioned to block a shot on the goal.

There are a number of sports in which the object of the sport is to propel an object past a goaltender and into a goal. Examples of such sports include hockey, soccer, field hockey, and lacrosse. In all such sports the body position of the goaltender is extremely important with respect to his ability to block a shot on the goal. In recent years, there has been increased interest in goaltender technique, however, few effective training aids are available to assist goaltenders in understanding the proper body position that should be assumed to be in position to block an incoming shot.

One goaltender training device is disclosed in U.S. Pat. No. 5,584,481 which employs cords that extend from take up reels mounted on the goalposts to the blade of a hockey stick, that is intended to identify the location of an object to be shot on the goal. The cords define the angles from the blade of the hockey stick to the goalposts and allow the goaltender to understand the angles that must be defended. This training apparatus, however, is not effective for providing instantaneous feedback to the goaltender with respect to the proper positioning or his arms, legs, and/or stick to block a shot from a point corresponding to the hockey stick since the cords only define a single line from the stick to the top of the goalpost.

It would therefore be desirable to have a goaltender training device that is of assistance to a goaltender in developing effective goaltending techniques and which provides feedback to the goaltender to allow the goaltender to understand when his arms, legs and/or stick are properly positioned to block an incoming shot.

BRIEF SUMMARY OF THE INVENTION

In accordance with the present invention, a training device for goaltenders is disclosed. The training device includes one or more transceivers each of which generate a beam that is focused on a corresponding reflector affixed to or positioned adjacent a goalpost of a goal. The transceivers are selectively positioned in one embodiment such that the beams cross one another at an intersection point that is assumed to correspond to a point at which the object to be shot on the goal would be located. More specifically, assuming the training device includes first and second spaced transceivers on the left and right side of the training device respectively, and the goal includes left and right vertical goal posts, the left transceiver directs a beam at a reflector affixed to the right vertical goal post and the right transceiver directs a beam at a reflector affixed to the left vertical goal post such that the beams cross when viewing the beams from a top view.

The beams transmitted by the respective transceivers are reflected by the corresponding reflectors mounted to the respective goalposts back to the transceiver in the situation in which the path between the respective transceiver and the reflective element is not interrupted. Each of the transceivers is coupled to a light. Upon detection of the reflected beam at a transceiver, the transceiver generates a signal that is used to activate a light so as to provide a visual indication that the path from the intersection point to the goal post remains unimpeded and that a shot on goal from the intersection point could enter the goal.

In use, the trainee goaltender assumes a position between the intersection point and the goal and positions his arms, legs and stick (if applicable) in an effort to interrupt all beams and turn off the lights associated with the respective transceivers. If one or more lights remain lit, the trainee may vary his distance from the goal, angular orientation with respect to a line from the intersection point to the center of the goal and his body position to interrupt the beams and obtain feedback indicative of the proper technique to block a shot that originates at the intersection point.

In practice, stacked transceivers may be employed on the left and the right sides of the training device which each emit a beam that is reflected from a reflective element on the opposite goal post. In one embodiment, three transceivers are arranged vertically one above the other on one side of the training device, and three transceivers are arranged vertically one above the other on the other side of the training device. By providing a plurality of vertically spaced transceivers, the transceivers may be focused on reflective elements at different heights on the respective vertical goal posts to allow the goaltender to obtain feedback regarding his positioning that involves arm, leg, pad and/or stick position.

Additionally, a transceiver may be provided that generates a beam that is focused on a reflective member generally in the center of the upper crossbar of the goal and another transceiver may be provided that is focused along the ground at a reflector located generally close to the ground and in the center of the goal. As discussed above, the transceivers are coupled to respective lights so as to provide visual feedback to the trainee whether each of the paths from the intersection point to the corresponding reflective members on the goal posts and crossbar are blocked when the goaltender has assumed a position between the intersection point and the goal.

The transceivers may comprise optical transceivers employing visible or invisible beams, such as infrared beams. The light beams may comprise generally collimated beams or lasers. Additionally, the beams may be ultrasonic beams that are reflected from respective reflectors on the goalpost and/or crossbar back to the respective transceivers. Moreover, the transceivers may be provided in the form of integrated transceivers or alternatively as separate transmitters that generate the desired beam and receivers that receive the respective reflective beam.

Other features, aspects and advantages of the disclosed goaltender training device will be apparent to those of ordinary skill in the art from the Detailed Description of the Invention that follows.

BRIEF DESCRIPTION OF THE SEVERAL VIEWS OF THE DRAWINGS

The invention will be more fully understood by reference to the following Detailed Description of the Invention in conjunction with the Drawing of which.

DETAILED DESCRIPTION OF THE INVENTION

In accordance with the present invention a training aid for goaltenders is disclosed. The presently disclosed system provides visual feedback to a goaltender than indicates whether he is positioned so as to block a shot on the goal from a specified position. The system is illustrated and discussed in terms of a goaltender defending a goal in the context of ice hockey, although it will be recognized by those of ordinary skill in the art that the disclosed system is suitable for use as a training aid for training goaltenders in various sports including but not limited to ice hockey, field hockey, soccer, lacrosse and/or any other sport in which a goaltender defends a goal and the object of the sport is to propel an object past the goaltender and into a goal.

Figure 1:
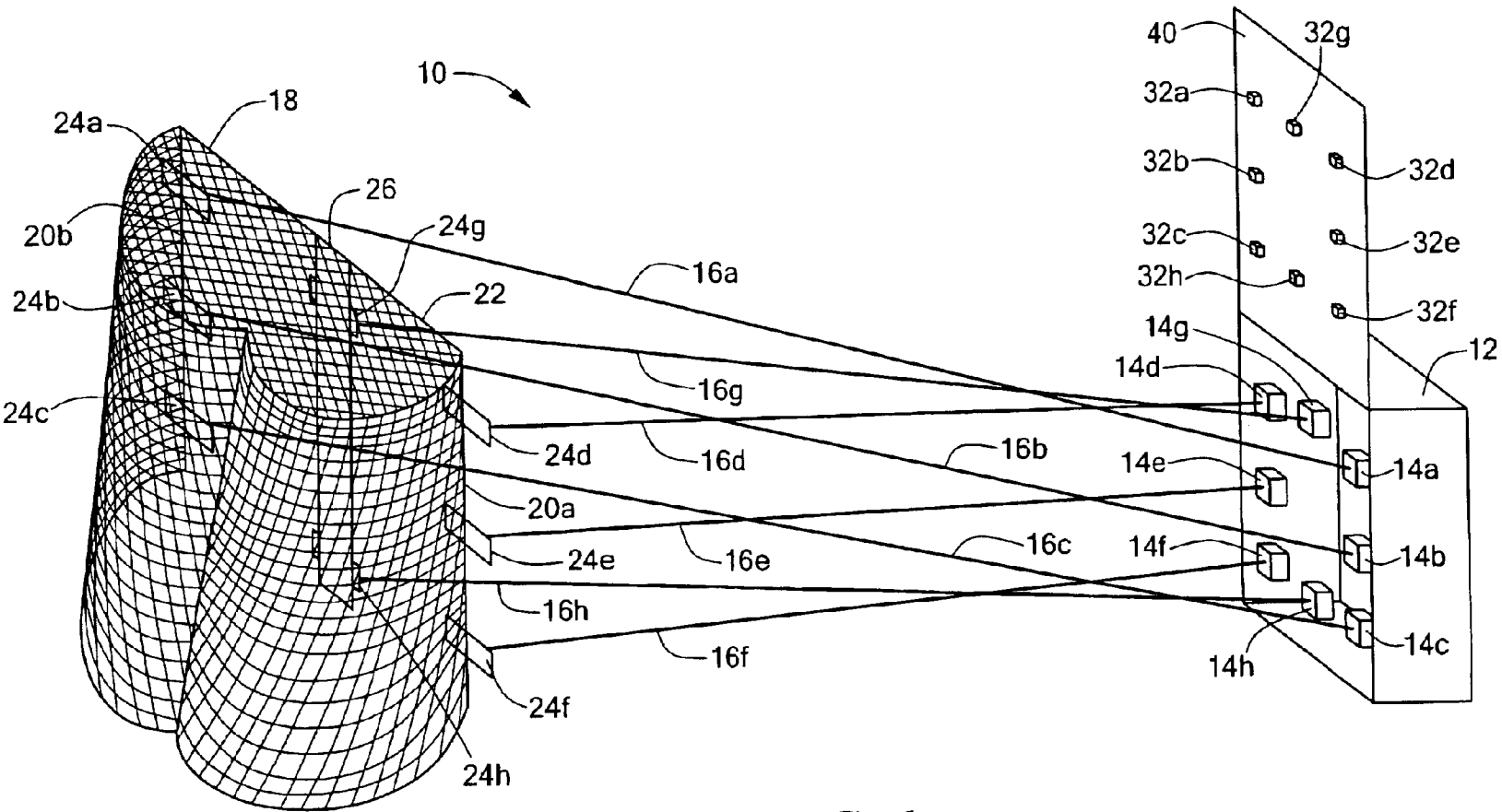
FIG. 1 is perspective view illustrative of a system operative in accordance with the present invention.

Referring to FIG. 1, the system 10 includes a housing 12 that includes a plurality of transceivers 14*a*–14*h* that emit beams 16*a*–16*h* respectively. A goal 18 having a pair of goalposts 20*a*, 20*b* and a crossbar 22 has reflectors 24*a*–24*f* mounted to the goalposts 20*a*, 20*b*. Additionally, reflectors 24*g*, 24*h* may be optionally attached to a vertically oriented strap 26 that is supported by the crossbar 22. The strap 26 may be fabricated of a rigid material such as a metallic or plastic material or alternatively of a flexible material.

The transceivers 14 may comprise, for example, optical transceivers such as the Model PE-31 Infrared Photoelectric Relay System produced by Philmore Manufacturing Co., Inc of Inwood, N.Y. or any other suitable optical transceiver. Each of the optical transceivers emits an infrared beam which is reflected back to a sensor housed with the infrared emitter from a selected one of the reflectors 24*a*–24*h* mounted to the goal 18 or the strap 26 supported from the crossbar 22. While one embodiment employs infrared beams, light within the visible spectrum may be employed. Moreover, low power laser beams may also be employed. Additionally, ultrasonic transceiver may also be employed. It is further noted that while the illustrated embodiment employs transceivers in which a transmitter and a receiver are housed within a common housing, the term transceiver is used broadly to encompass any combination of a transmitter for generating a beam that may be reflected off of a reflector and a receiver that is capable of detecting the reflected beam whether commonly housed or not. Moreover, each transceiver includes a transmitter portion and a receiver portion.

Figure 2:
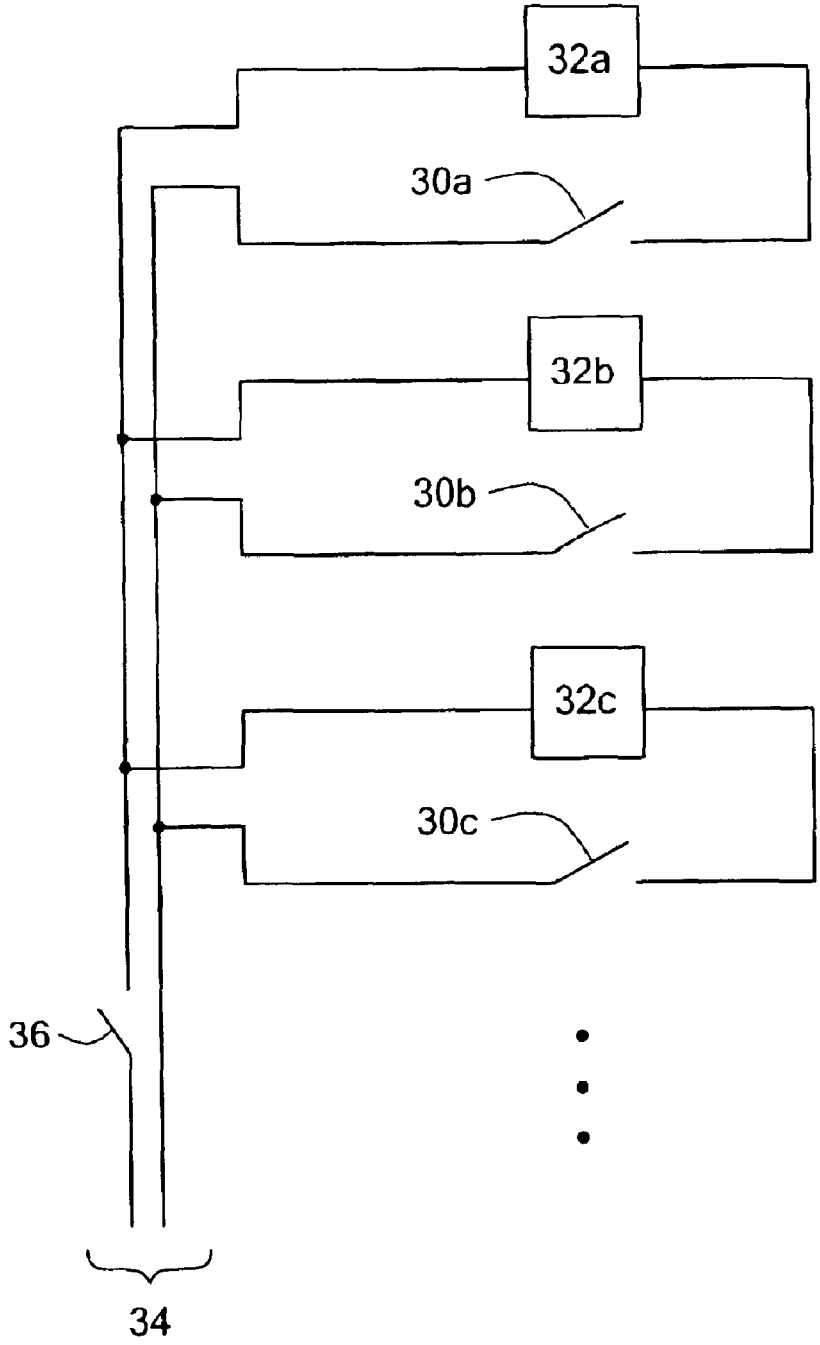
FIG. 2 is a diagram illustrative of the wiring of the visual annunciators depicted in FIG. 1.
Figure 3:
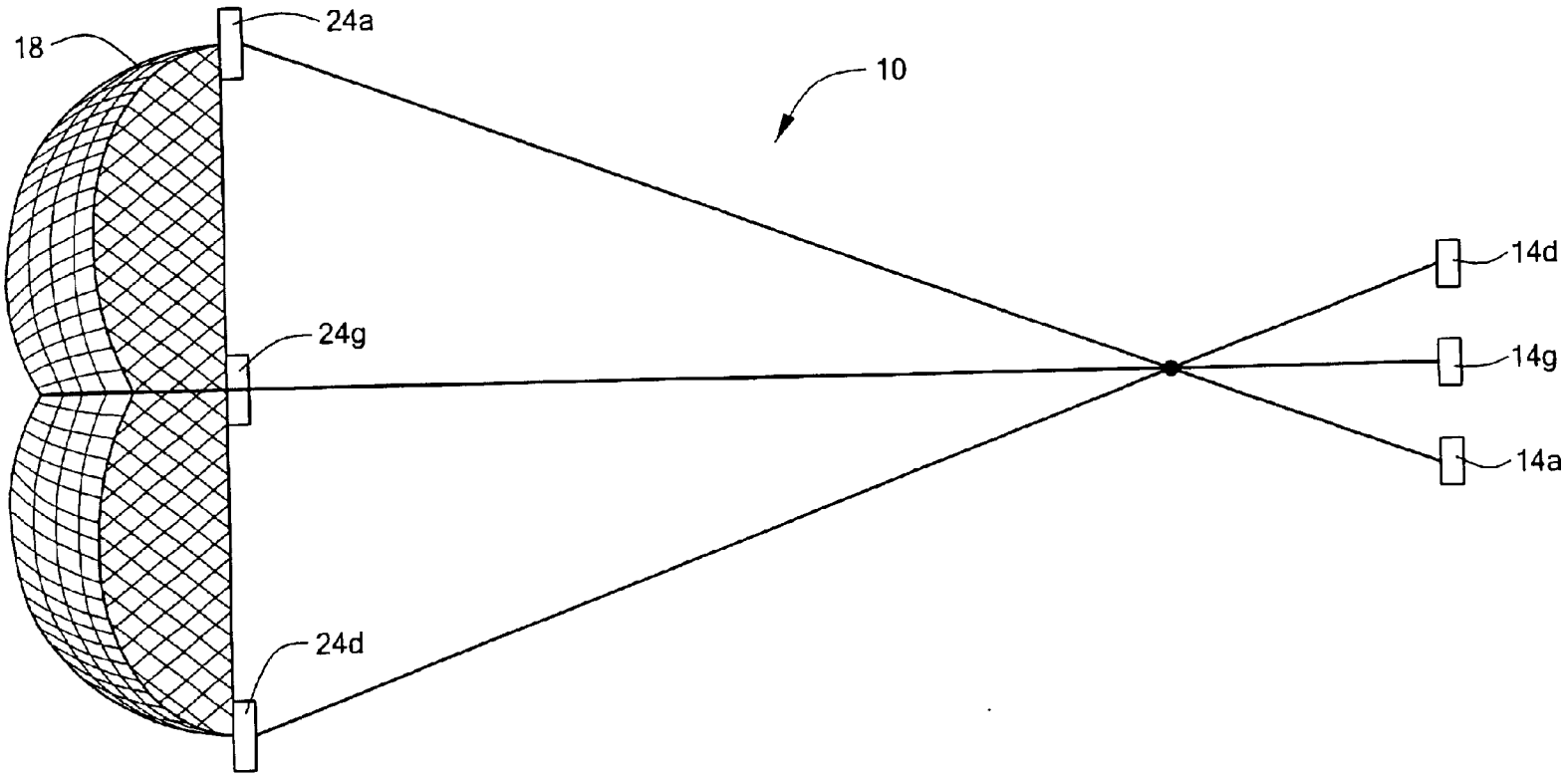
FIG. 3 is a schematic top view of the system of FIG. 1 depicting the beam paths from the transceivers to respective reflectors and back to the transceivers.

Each transceiver 14 and a corresponding reflector are positioned so that at least a portion of the emitted beam from the respective transceiver 14 is reflected from a cooperative reflector 24 back to the transceiver 14. Referring to FIG. 2, the receiver portion of each transceiver includes a switch 30, which may be mechanical or electronic which assume first state when the emitted beam is reflected back to the respective receiver and which assumes a second state when the emitted beam is not reflected back to the respective transceiver. In the illustrative embodiment, the switches 30*a*–30*h* are associated with the transceivers 14*a*–14*h* respectively and the switches 30 are assumed to be closed when a beam emitted from a transceiver 14 is reflected back to that transceiver 14 and which is open when a beam emitted from a transceiver 14 is not reflected back to that transceiver 14. Each of the switches 30*a*–30*g* is connected in series with an annunciator such as a light 32*a*–32*g*. The two legs of each of the series circuits comprising the switches 30 and the lights 32 are coupled to a power source 34 through a power switch 36. Thus, in the illustrated embodiment, when a beam 16 that is emitted from a transceiver 14 is reflected back to the transceiver 14, the light 32 associated with that transceiver 14 turns on and when a beam 16 that is emitted from a transceiver 14 is not reflected back to the transceiver 14, the corresponding light 32 is not turned on.

Referring to FIG. 1, the lights 32 are mounted to the inside of the cover of the housing 12 so that the lights 32 may be seen by a goaltender positioned between the goal 18 and the housing 12 when the cover 40 is pivotally opened and positioned as illustrated. Thus, the light 32*a* will be on if the beam 16*a* is not interrupted and will be off if the beam 16*a* is interrupted, the light 32*b* will be on if the beam 16*b* is not interrupted and will be off if the beam 16*b* is interrupted, etc.

Each of the transceivers 14 is movable so as to allow the transceivers to be focused on the cooperative reflector 24. In particular, the transceiver 14*a* is directed at the reflector 24*a*, the transceiver 14*b* is directed at the reflector 24*b*, the transceiver 14*c* is directed at the reflector 24*c*, etc. so as to achieve the above-described operation of the lights 32 with respect to interrupted and non-interrupted beams 16.

The setup of the training device is discussed in connection with respect to the top view of the system 10 which depicts the transceivers 14 in top view and the goal 18 spaced therefrom. The spacing of the housing 12 from the goal 18 may vary greatly from approximately 10 feet to 75 feet or more depending on the sport of interest and the capabilities of the transceivers employed. The centrally located transceivers 14*g*, 14*h* are aligned with the centrally located reflectors 24*g*, 24*h* respectively such that the emitted beams are received back at the respective transceivers. The other transceivers 14 are aligned with respective reflectors 24 such that the beams emitted by transceivers 14*a*, 14*b*, 14*c* cross the beams emitted by transceivers 14*d*, 14*e*, 14*f*. After aligning the transceivers 14 with the reflectors 24 as described above, a generally vertical member, which may be around 1 inch wide or any other suitable width, is positioned along the path of one of the central beams 16*g*, 16*h* and slidably positioned along that path until all of the beams 16 are interrupted as indicated by all of the lights 32 being in the off or non-illuminated state. An object 50, such as a puck is then disposed on the ice or ground as applicable at the general location where the beams 16 cross.

The presently disclosed training system 10 may be used with or without one or more centrally located transceivers although it is desirable to employ at least one centrally located transceiver 14 during the setup and alignment of the system. Moreover, the number of transceivers 14 on each side of the housing may be varied. In particular, one or more transceivers 14 may be employed on each side of the housing 12. A corresponding number of reflectors 24 are typically mounted or positioned adjacent the goalposts 20*a*, 20*b*.

Figure 4:
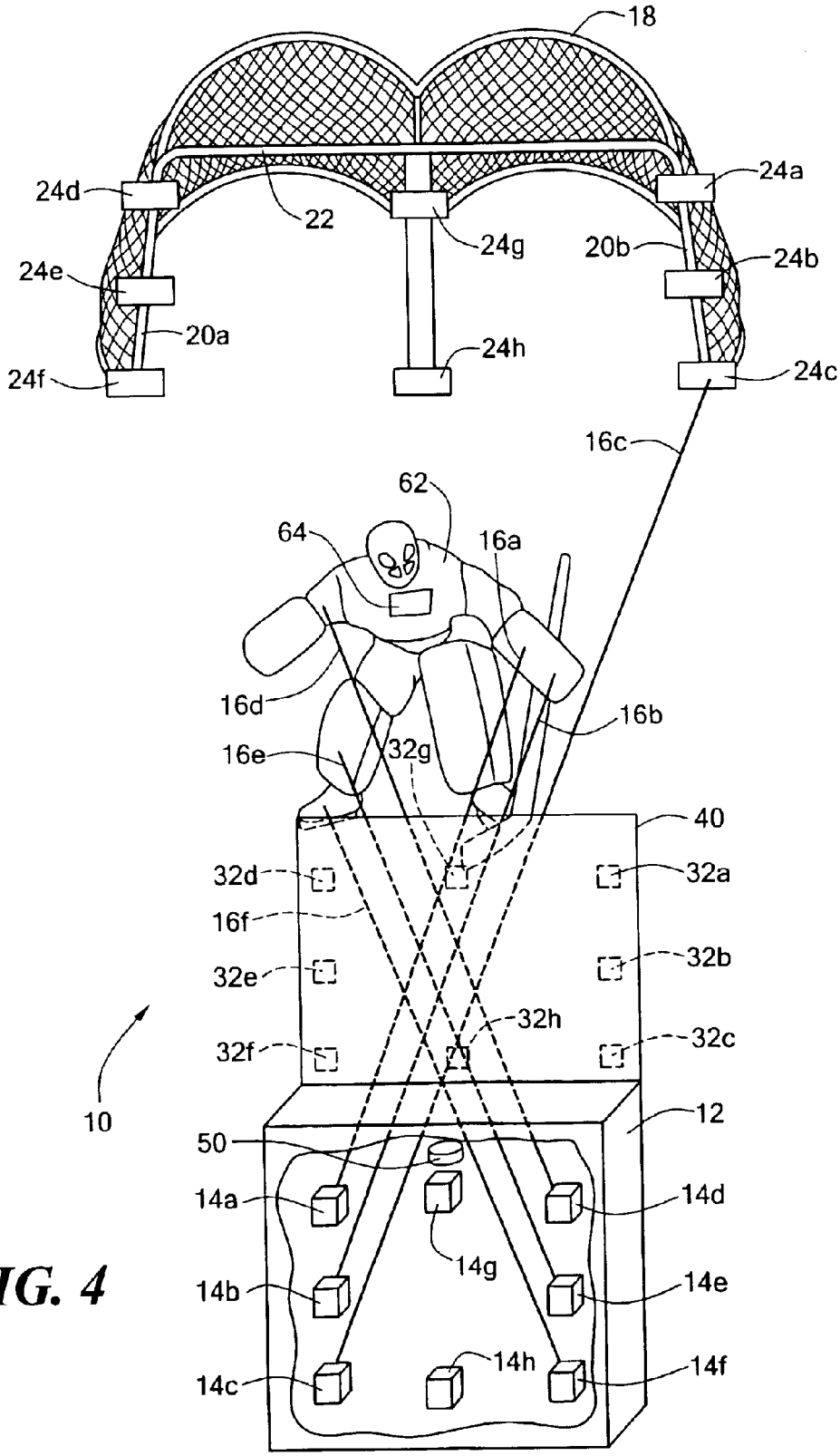
FIG. 4 is a partial perspective cutaway view illustrating the operation of the goaltender training system of FIG. 1.

The use of the above-described training apparatus is further illustrated by reference to FIG. 4. A 60 goaltender assumes a position between the object 50 and the goal 18 and positions his arms, legs, pads and/or stick, as applicable to interrupt the beams 16 emitted by the transceivers 14. The goaltender 60 may wear a vest or other suitable garment 62 having a reflector 64 affixed to the garment. The goaltender 60 may determine that he is on the centerline from the object 50 to the goal 18 by assuming a position at which the annunciator 32*g* associated with transceiver 14*g* is on though he is in a position that would interrupt the beam between the transceiver 14*g* and the reflector 24*g* were he not wearing the garment 62 having the reflector 64 mounted thereon. After assuming a position on the centerline to the goal 18, the goaltender 60 may remove or cover the reflector 64 so that the annunciator 32*g* functions like the other annunciators 32 to provide an indication of goal 18 coverage. Noting the above use the transceiver 14*g* for center position detection, the number of beams 16 interrupted by the goaltender 60 generally provides an indication of whether the goaltender's position would be effective in blocking a shot from the position of the object 50 to a location on the goal 18 generally in the location of the respective reflector. Should the goaltender 60 not interrupt one of the beams 16, the applicable light 32 will be illuminated so as to provide feedback to the goaltender 60 that a path from the object 50 to the area of the goal 18 associated with the applicable reflector is not blocked. The goaltender 60 may then vary his distance from the goal 18 and body position to attempt to obtain greater coverage of the goal 18. By way of example, referring to FIG. 4, the position assumed by the goaltender 60 has effectively interrupted beams 16*a*, 16*b*, 16*d*, 16*e* and 16*f* although beam 16*c* remains uninterrupted. The light 32*c* (FIG. 1) would thus be lit to provide visual feedback to the goaltender 60 that a shot from the location of the object 50 to the lower right hand portion of the goal 18 in the vicinity of reflector 24*c* is not blocked. In this manner the goaltender 60 may obtain immediate feedback from the system 10 indicative of his effectiveness in guarding against a shot on the goal 18 emanating from the position of the object 50.

The housing 12 may be moved to different positions in terms of the distance from the goal 18 and side to side to allow the goaltender 60 to obtain feedback regarding goal 18 coverage for shots from different positions.

It should be appreciated that while three transceivers 14 are shown in the present embodiment on each side of the housing 12, one or more transceivers may be employed on opposing sides of the housing. Additionally, while the beams 16 are shown as crossing in the illustrated embodiment to facilitate positioning of the object 50, the transceivers 14 may be oriented so that the emitted beams 16 do not cross, but rather, are reflected off of the reflectors 24 on the same side of the centerline defined by one of the beams 16 emitted by transceivers 14*h* or 14*g*.

It should also be appreciated that while the reflectors are described as being mounted to the goal, the reflectors may be mounted to one or more stands which are positioned adjacent the goal in a desired location.

It should be appreciated that variations of and modifications to the above-described goaltender training apparatus may be made without departing from the inventive concepts disclosed herein. Accordingly, the invention should not be viewed as limited except as by the scope and spirit of the appended claims.

What is claimed is:

1. Goaltender training apparatus for providing feedback regarding the positioning of a goaltender between a goal and said training apparatus, said training apparatus comprising;

at least one reflector selectively positioned adjacent said goal;

at least one transceiver spaced from said goal, each of said at least one transceiver being operative in a first state to emit a beam that is directed along a path so as to reflect from a corresponding one of said at least one reflector back to the respective transceiver when said path is uninterrupted and to provide a first output condition in response to receipt of said reflected beam, and wherein said transceiver is operative to provide a second output condition in the event said path is interrupted by said goaltender; and at least one annunciator associated with each of said at least one transceiver for providing a first indication in response to said first output condition from the respective transceiver and a second indication in response to said second output condition from the respective transceiver, wherein each of said at least one annunciator is responsive to the position of said goaltender at a given time to provide one of said first and second indications.

2. The training apparatus of claim 1 wherein said at least one transceiver is an optical transceiver and said at least one reflector is an optical reflector.

3. The training apparatus of claim 1 wherein said beam is an infrared beam.

4. The training apparatus of claim 1 wherein said at least one annunciator comprises a visual annunciator.

5. The training apparatus of claim 4 wherein said each said at least one visual annunciator comprises a light.

6. The training apparatus of claim 1 wherein each of said at least one transceiver is an ultrasonic transceiver and each of said at least one reflector is an ultrasonic reflector.

7. The training apparatus of claim 1 wherein said beam emitted from said at least one transceiver comprises a laser beam.

8. The training apparatus of claim 1 wherein said at least one reflector is mounted to said goal.

9. The training apparatus of claim 8 wherein said goal includes a pair of vertical goalposts and said at least one reflector is mounted to at least one of said pair of vertical goalposts.

10. The training apparatus of claim 1 wherein, said at least one transceiver includes first and second transceivers and said at least one reflector includes first and second reflectors, and wherein said first transceiver emits a first beam that is reflected from said first reflector back to said first transceiver along a first path when said first path is uninterrupted and said second transceiver emits a second beam that is reflected from said second reflector back to said first transceiver along a second path when said second path is uninterrupted.

11. The training apparatus of claim 10 wherein said first path generally crosses said second path.

12. The training apparatus of claim 1 wherein each one of said at least one transceiver includes a tranmitter operative to emit said beam and a receiver operative to detect said emitted beam.

13. The training apparatus of claim 12 wherein said transmitter and receiver of each of said at least one transceiver are separate components.

* * * * *